US010953262B2

(12) United States Patent
Garcia Castillo

(10) Patent No.: US 10,953,262 B2
(45) Date of Patent: Mar. 23, 2021

(54) WEIGHT PLATES

(71) Applicant: Hevert Adolfo Garcia Castillo, Guatemala C.A. (GT)

(72) Inventor: Hevert Adolfo Garcia Castillo, Guatemala C.A. (GT)

( * ) Notice: Subject to any disclaimer, the term of this patent is extended or adjusted under 35 U.S.C. 154(b) by 45 days.

(21) Appl. No.: 16/140,373

(22) Filed: Sep. 24, 2018

(65) Prior Publication Data

US 2020/0094100 A1 Mar. 26, 2020

(51) Int. Cl.

| | |
|---|---|
| ***A63B 21/02*** | (2006.01) |
| ***A63B 21/072*** | (2006.01) |
| ***A63B 21/06*** | (2006.01) |
| *A63B 21/00* | (2006.01) |

(52) U.S. Cl.

CPC ..... *A63B 21/0728* (2013.01); *A63B 21/06* (2013.01); *A63B 21/0601* (2013.01); *A63B 21/072* (2013.01); *A63B 21/0724* (2013.01); *A63B 21/0004* (2013.01); *A63B 21/00058* (2013.01); *A63B 21/00061* (2013.01); *A63B 21/00065* (2013.01)

(58) Field of Classification Search

CPC ..... A63B 21/0724; A63B 21/0728; A63B 21/0004; A63B 21/00058; A63B 21/00065; A63B 21/00061; A63B 21/06; A63B 21/0601; A63B 21/072

See application file for complete search history.

(56) References Cited

U.S. PATENT DOCUMENTS

| | | | | |
|---|---|---|---|---|
| 709,366 | A | 9/1902 | Sexton | |
| 2,244,351 | A | 3/1940 | Venables | |
| 2,497,550 | A | 2/1950 | Jeffries | |
| 3,305,234 | A | 2/1967 | Cline et al. | |
| 4,054,394 | A | 10/1977 | Neuman | |
| 4,588,191 | A | 5/1986 | Stewart | |
| 4,639,979 | A | 2/1987 | Polson | |
| 4,948,123 | A | 8/1990 | Schook | |
| 4,971,318 | A * | 11/1990 | Tracy | A63B 21/0728 482/107 |
| 5,123,885 | A * | 6/1992 | Shields | A63B 21/0728 482/106 |
| 5,295,933 | A | 3/1994 | Ciminski et al. | |
| 5,591,109 | A | 1/1997 | Strand | |
| 6,746,380 | B2 * | 6/2004 | Lien | A63B 21/06 482/106 |
| 6,776,741 | B2 | 8/2004 | Burwell | |
| 9,555,281 | B2 | 1/2017 | Beckman | |
| D780,861 | S | 3/2017 | Jones | |

(Continued)

FOREIGN PATENT DOCUMENTS

| | | | |
|---|---|---|---|
| GB | 2186500 | A | 8/1987 |
| GB | 2220148 | A | 4/1990 |

(Continued)

*Primary Examiner* — Megan Anderson

(74) *Attorney, Agent, or Firm* — Ernesto Garcia

(57) ABSTRACT

A weight plate with a contained clamp inside a housing formed from features of the weight plate. The clamp is enclosed by the weight plate features and held in place from coming out of the housing using a fastener. Once the clamp is held, the clamp will not rotate on its own axis of rotation inside the housing. This prevents the clamp from being lost and provides easy clamping of the weight plate to a bar.

18 Claims, 2 Drawing Sheets

(56) References Cited

U.S. PATENT DOCUMENTS

| | | | | |
|---|---|---|---|---|
| 9,764,183 | B2 | 9/2017 | Stone et al. | |
| 10,478,657 | B1 * | 11/2019 | Demo | A63B 21/0722 |
| 2005/0075221 | A1 * | 4/2005 | Fond | A63B 21/0724 482/93 |
| 2006/0217244 | A1 | 9/2006 | Hudson | |
| 2008/0287271 | A1 | 11/2008 | Jones | |
| 2014/0162855 | A1 | 6/2014 | Beckman | |
| 2014/0287890 | A1 | 9/2014 | Binder et al. | |
| 2017/0095688 | A1 | 4/2017 | Stilson | |

FOREIGN PATENT DOCUMENTS

| | | | |
|---|---|---|---|
| SE | 167983 | C1 | 8/1959 |
| WO | 2015144955 | A1 | 10/2015 |

* cited by examiner

WEIGHT PLATES

FIELD OF THE INVENTION

The invention relates to the field of weight training devices such as barbells and dumbbells that use lockable weight plates.

DESCRIPTION OF THE PRIOR ART

Exercise weights are used for recreational purposes in schools, rehabilitation purposes in physical therapy settings and by the general public as a tool to improve and maintain physical fitness. Weight lifting for improvement and maintenance of physical fitness has led to an increase in physical fitness facilities and use of in-home exercise equipment. Exercise weights consist of barbells or dumbbells, and weight plates. Barbells are used in conjunction with weight plates to achieve a desired weight amount.

Weight plates traditionally consist of a disc shaped mass with a cylindrical hole placed through the center of the plate to retain the plate to the bar. Barbells have a cylindrical handle, longer than a dumbbell. Weight masses are attached at both ends of the bar, or the bar can accept weight plates at both ends to reach a desired overall mass. The weight plates are mounted on the barbell sleeve, which is a component that is permanently attached the barbell. The barbell sleeve consists of a sleeve collar and a sleeve body.

When using a barbell or dumbbell, the free weights need to be securely fastened to the bar and easy to use. Unexpected movement of the weight plates need to be prevented for safety. The weight plates need to be secured in a manner that does not damage the barbell, the weight plates, or the dumbbell. When exercising and you want to hold the weights in the bar with the clamps, these are never in place and one has to go and look for them and sometimes there is none around.

Prior art in the field seeks to achieve securing the weight plate by placing a clamp adjacent to the weight plate or use a setscrew that presses against a sleeve. Patent application, US2006/0217244 A1, to Hudson, teaches placing threaded fastener that pushes on a concentric sleeve thus locking the weight plate in place. This threaded fastener is in the plane of the weight plate and one can access the threaded fastener through an access opening of the weight plate. A disadvantage of the Hudson patent is that there comes a point when turning the lever to tighten, the lever would be perpendicular to the weight plate that if one were to put another adjacent weight, the adjacent weight would hit the lever.

Others have used spring-loaded cams, suction cups, or retractable balls to lock the weight plate to the bar. For those that use c-clamps or lever-type clamps, these clamps make the barbell bulky and one can loose the clamps. Patent application, US2008/0287271A1, and design application USD780,861, both to Jones, depict a lever type clamp that is adjacent to the weight plate. This requires one to place the weight plate first into the bar and then later place the clamp as a secondary step thus locking the weight plate.

SUMMARY OF THE INVENTION

The present invention includes an improved locking system to weight plates so that each weight plates contains within a housing a lever-type clamp. The clamp is contained in a housing centered to the plane of the weight plate. The clamp, while being known to exist per se, is not the crux of the invention. Instead, the combination of the improved implementation in a weight plate has not existed or been suggested by the prior art. It envisioned that the clamp is housed in the center of the weight plate to prevent a secondary step of placing the clamp after inserting the weight plate to a bar. It is further envisioned that the clamp is contained within the housing to be non-rotatable within its own central axis thus kept in the housing and not dislodged from the housing. It envisioned that the weight plate will have at least one access opening to have a dual function, one creating a handle for carrying the weight and an access location to allow one to lock and unlock the clamp.

The present invention further includes a pair of rubber pads inside the clamp to provide lock friction against the bar. The rubber pads are fastened to pivotable clamp arches of the clamp either by gluing, fastening, or any means of retaining the rubber pad against a surface of the arches of the clamp. It is envisioned that the body features of the clamp can be made from plastic, a combination of plastic and metal, or composite materials.

DETAILED DESCRIPTION OF PREFERRED EMBODIMENTS

Figure 1:
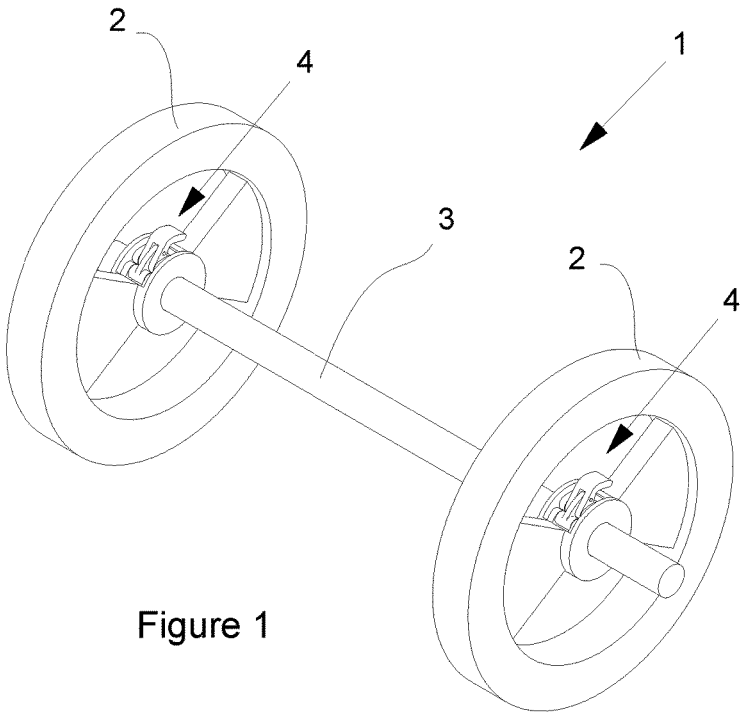
FIG. 1 is an isometric view of a barbell system implementing the present invention.
Figure 2:
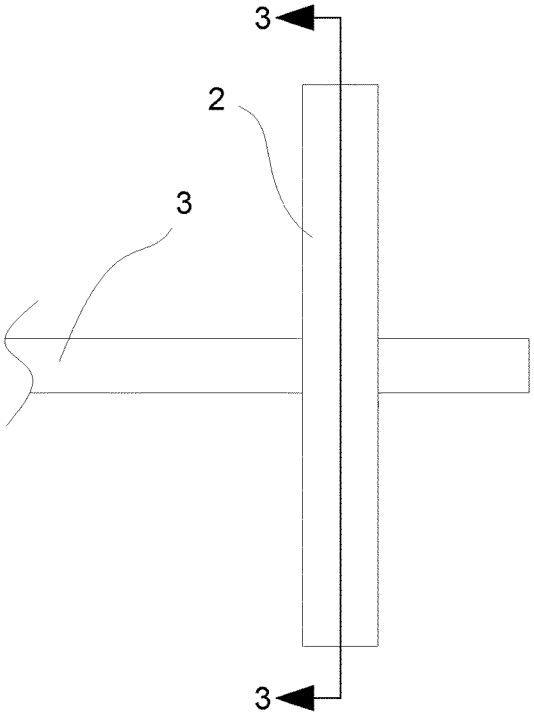
FIG. 2 is a side view of one of the weight plates shown in FIG. 1.
Figure 3:
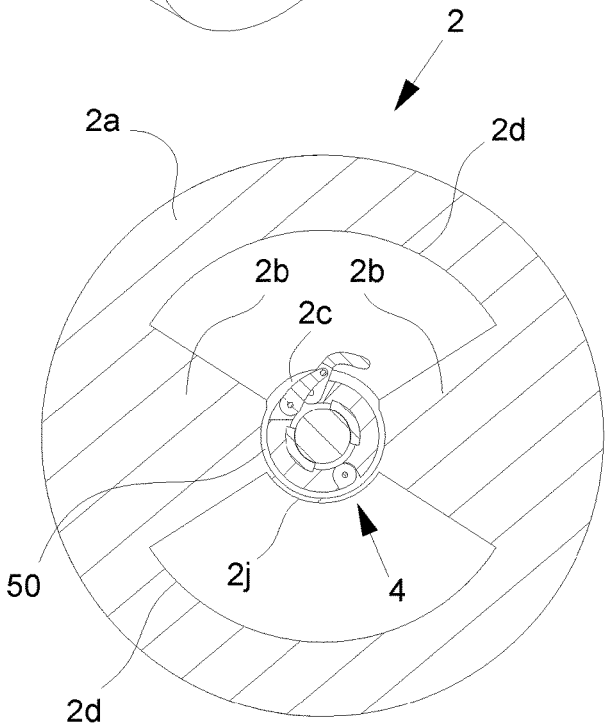
FIG. 3 shows cross-section view 3-3 of the weight plate as shown in FIG. 2.
Figure 4:
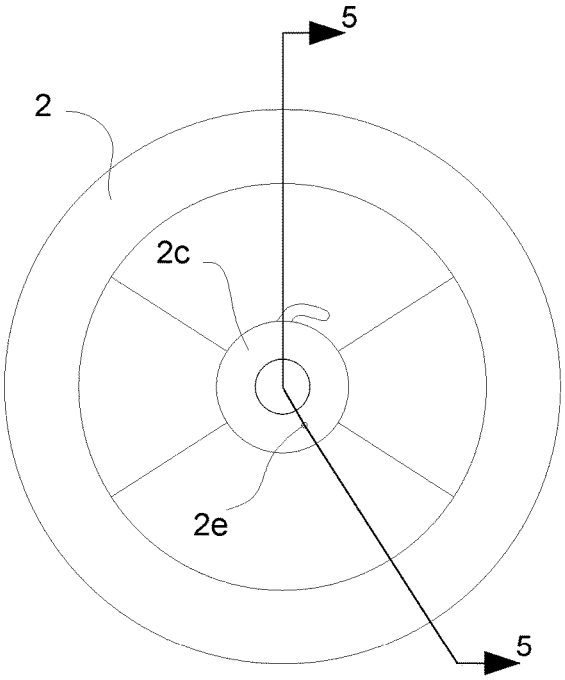
FIG. 4 is a front view of one of the weight plates shown in FIG. 1.
Figure 5:
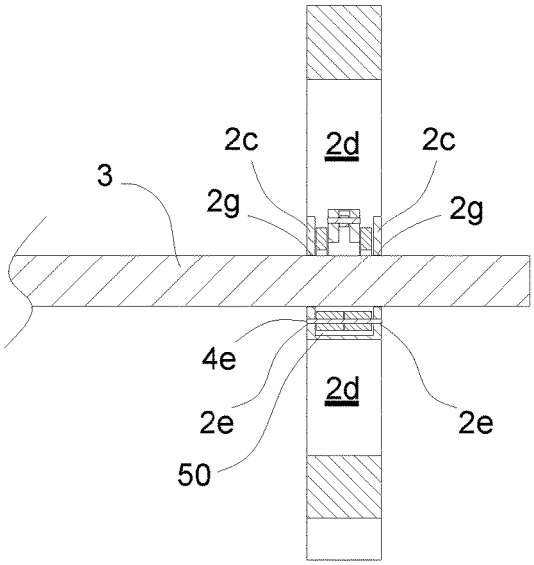
FIG. 5 shows cross-sectional view 5-5 shown in FIG. 4.

FIG. 1 shows a dumbbell 1 comprising a pair of weight plates 2 and each weight plate 2 including a clamp 4 housed within the weight plates 2. A shown in FIG. 3, each weight plate 2 comprises an ordinary disk mass 2*a*, at least two bridge sectors 2*b* projecting radially inwardly from the disk mass 2*a* towards a center of the weight plate 2 and a housing 50 therein. The weight plate 2 further includes two access openings 2*d* to act as a handle for carrying the weight plate 2. The housing 50 is formed from a pair parallel collars 2*c* and an arched wall 2*j* forming an enclosure having a side opening 2*f*. Each of the collars 2*c* includes a retaining hole 2*e* to receive a retaining pin 4*e* of the clamp 4 as best shown in FIG. 5. The collars 2*c* are disc shaped with an opening 2*g*, resembling a flat washer. The opening 2*g* is sized to accept the bar 3. As shown in FIG. 5, the housing 50 separates the center openings 2*g* of the collars 2*c*.

Figure 6:
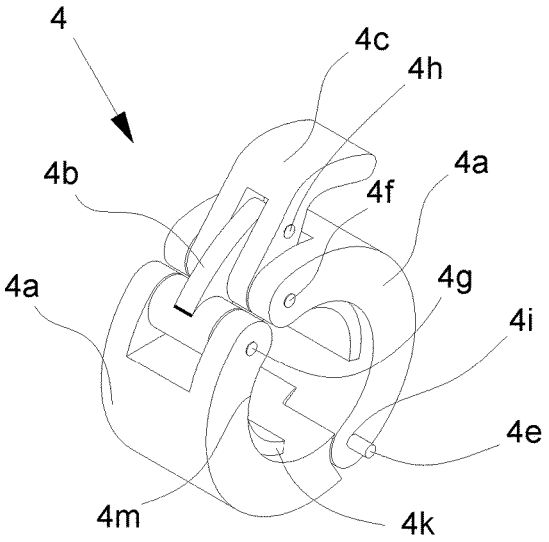
FIG. 6 is an isometric view of the clamp used in the barbell system shown in FIG. 1.
Figure 7:
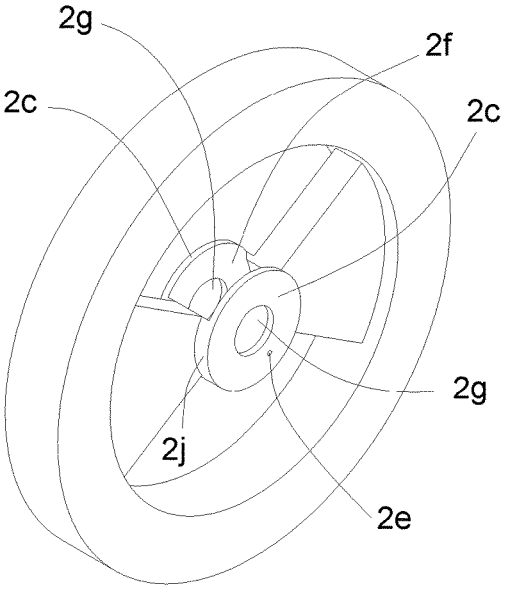
FIG. 7 is an isometric view of the weight plate without its clamp to show details of the weigh plate solely.

The clamp 4 is received into the housing 5 through the opening 2*f* of the housing 50 in which the clamp resides permanently inside the weight plate 2. The clamp 4 as shown in FIG. 6 comprises a pair of identical arches 4*a* that are stacked back to back with each other forming a circular bar opening 4*m*. The clamp 4 further includes a linkage 4*b* pivotally rotatable on one of the arches 4*a* using an arch pin 4*g*. A lever 4*c* is pivotally fixed to an end of the linkage 4*b* using a link pin 4*h*. The lever 4*c* is accessed through one of the access openings 2*d* of the weight plate 2 so that one can lock and unlock the clamp 4. The lever 4*c* is also pivotally fixed at the other arch 4*a* using two pivot pins 4*f*. It should be noted that the isometric view in FIG. 6 only shows one side but the backside will also have another pivot pin 4*f*. The retaining pin 4*e*, previously discussed, pivotally connects the two arches 4*a* together. The retaining pin 4*e* is fitted in a retaining hole 4*i* of each arch 4*a*, and also the retaining pin 4*e* is press fitted into the retaining hole 2*e* of each collar 2*c*. It is envisioned that the retaining pin 4*e* can be pressed fitted in only one of the collars 2*c* instead of both collars 2*c*. The reason for retaining the clamp 4 inside the housing 50 is so that the clamp 4 does not rotate on its own axis of rotation or come out of the housing 50.

It is envisioned that the clamp 4 is a split type common clamp and that the clamp 4 per se is well known in the art. It is also known that this type of clamp 4 include a pair of rubber pads 4*k* so as to not damage the bar 3 and provide greater clamping friction. It is envisioned that the clamp 4 can be made entirely from metal except the rubber pads 4*k*, or a combination of plastic for the entire clamp 4 and metal for the pins 4*f*, 4*g*, 4*h*. It should be noted that the pins 4*f*, 4*g*, 4*h* are pressed fit pins but of course the pins 4*f*, 4*g*, 4*h* can be replaced with rivets or threaded fasteners. It is also within the scope of the invention that the clamp 4 can use a different type of locking and unlocking feature such as having a cam lock lever instead of using a linkage 4*b* to close the clamp 4. The motion of the lever 4*c* is parallel to a plane of the weight plate 2.

The invention claimed is:

1. A weight plate comprising a disk mass, a pair of bridge sectors extending radially into a center of the disk mass, a pair of collars extending between the pair of bridge sectors forming a housing therein;

wherein the weight plate further including at least one access opening;

wherein each of the pair of collars comprising a center opening and extend parallel to each other; and, wherein a clamp is contained within the housing, and the clamp including a bar opening and a lever accessible through the at least one access opening; wherein the housing separates the center opening of the pair of collars.

2. The weight plate of claim 1, wherein the clamp further comprising two identical arches stacked back to back; the two identical arches each including a mounting opening;

wherein each of the pair of collars further comprising a mounting opening; and wherein a retaining pin is fixed to the mounting opening of both of the two identical arches and the mounting opening of at least one of the pair of collars.

3. The weight plate of claim 2, wherein the clamp further comprising a pair of rubber pads within the bar opening.

4. The weight plate of claim 1, wherein the clamp further comprising two identical arches stacked back to back; the two identical arches each including a mounting opening;

wherein each of the pair of collars further comprising a mounting opening; and wherein a retaining pin is fixed to the mounting opening of both of the two identical arches and the mounting opening of both of the pair of collars.

5. The weight plate of claim 4, wherein the clamp further comprising a pair of rubber pads within the bar opening.

6. The weight plate of claim 1, wherein the housing further includes an arched wall and a side opening to allow insertion of the clamp into the housing.

7. The weight plate of claim 1, wherein the lever being rotatable along a central plane of the disk mass.

8. A barbell comprising a pair of weight plates and a bar fitted through the pair of weight plates;

wherein each of the weight plates comprising a disk mass, a pair of bridge sectors extending radially into a center of the disk mass, and a pair of collars extending between the pair of bridge sectors forming a housing therein;

wherein each of the weight plates further including at least one access opening;

wherein each of the pair of collars comprising a center opening and extend parallel to each other; and, wherein a clamp is contained within the housing of each of the weight plates, and the clamp including a bar opening and a lever accessible through the at least one access opening; wherein the clamp, contained within the housing of each of the pair of weight plates, further comprising two identical arches stacked back to back; the two identical arches each including a mounting opening; wherein each of the pair of collars further comprises a mounting opening; and wherein a fastener is fixed to the mounting opening of both of the two identical arches and the mounting opening of at least one of the pair of collars.

9. The barbell of claim 8, wherein the fastener is fixed to the mounting opening of both of the two identical arches and the mounting opening of both of the pair of collars.

10. The barbell of claim 9, wherein the clamp, contained within the housing of each of the pair of weight plates, further comprising a pair of rubber pads within the mass disk.

11. The barbell of claim 8, wherein the housing of each of the pair of weight plates further includes an arched wall and a side opening to allow insertion of the clamp into the housing.

12. The barbell of claim 8, wherein the clamp, contained within the housing of each of the pair of weight plates, further comprising a pair of rubber pads within the bar opening.

13. The barbell of claim 8, wherein the lever of the clamp contained within the housing of each weight plate being rotatable along a central plane of the disk mass.

14. A weight plate comprising a disk mass, a pair of bridge sectors extending radially into a center of the disk mass, a pair of collars extending between the pair of bridge sectors, an arched wall also extending between the pairs of bridge sectors; wherein the pair of collars and the arched wall forming a housing therein;

wherein the weight plate further including at least one access opening;

wherein each of the pair of collars comprising a center opening and extend parallel to each other; and, wherein a clamp is contained within the housing, and the clamp including a bar opening and a lever accessible through the at least one access opening.

15. The weight plate of claim 14, wherein the clamp further comprising two identical arches stacked back to back; the two identical arches each including a mounting opening;

wherein each of the pair of collars further comprising a mounting opening; and wherein a retaining pin is fixed to the mounting opening of both of the two identical arches and the mounting opening of at least one of the pair of collars or the mounting opening of both of the pair of collars.

16. The weight plate of claim 15, wherein the clamp further comprising a pair of rubber pads within the bar opening.

17. The weight plate of claim 14, wherein the housing further includes a side opening to allow insertion of the clamp into the housing.

18. The weight plate of claim 14, wherein the lever being rotatable along a central plane of the disk mass.

* * * * *